US006597637B2

(12) United States Patent
Wyssbrod

(10) Patent No.: US 6,597,637 B2
(45) Date of Patent: Jul. 22, 2003

(54) ELECTRONIC CHRONOGRAPH WATCH WITH ANALOGUE DISPLAY

(75) Inventor: Baptist Wyssbrod, Bienne (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 110 days.

(21) Appl. No.: 09/987,975

(22) Filed: Nov. 16, 2001

(65) Prior Publication Data

US 2002/0064099 A1 May 30, 2002

(30) Foreign Application Priority Data

Nov. 29, 2000 (CH) ..... 2323/00

(51) Int. Cl.[7] ..... G04F 10/00; G04F 8/00
(52) U.S. Cl. ..... 368/110; 368/113
(58) Field of Search ..... 368/110–113

(56) References Cited

U.S. PATENT DOCUMENTS 4,537,514 A 8/1985 Moriya
4,623,260 A * 11/1986 Kamiyama ..... 368/80
4,655,606 A * 4/1987 Giger ..... 368/160
5,166,912 A * 11/1992 Kanesaka ..... 368/110

FOREIGN PATENT DOCUMENTS

EP 493613 8/1992
EP 502292 9/1992

* cited by examiner

*Primary Examiner*—Vit Miska
(74) *Attorney, Agent, or Firm*—Sughrue Mion, PLLC

(57) ABSTRACT

An electronic chronograph watch (1) with an analogue display wherein the measured times are displayed on small dials (5, 6, 7) located on the periphery of the main dial (2). The measured times are displayed by small hands (8, 9, 10) each driven by a motor. The watch (1) includes a stem-crown (11) used to adjust the position of the hands (3, 4) indicating the current time via conventional mechanical means. The watch further includes at least two push-buttons (12, 13) which, when manipulated, allow access to all the functions of the chronograph part, including the function of adjusting the rest position of the chronograph hands (8, 9, 10).

14 Claims, 4 Drawing Sheets

ELECTRONIC CHRONOGRAPH WATCH WITH ANALOGUE DISPLAY

Figure 1:
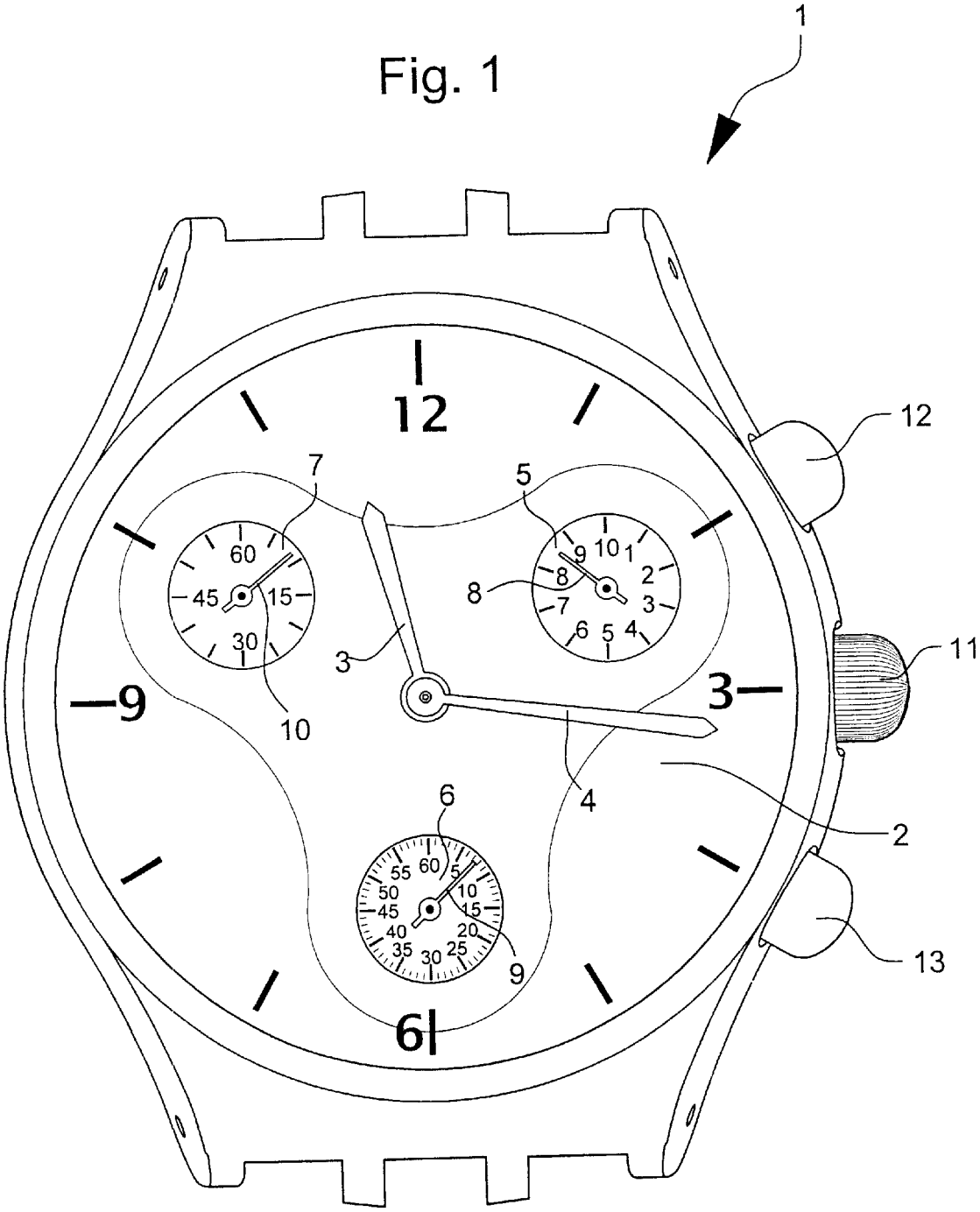

The present invention concerns an electronic analogue chronograph watch including at least a first motor driving hands for displaying the current time, at least a second motor driving at least a chronograph hand, a stem-crown for adjusting or setting the current time and two push-buttons for controlling the chronograph functions, the watch including two operating modes for the chronograph, the first of these modes being the current operating mode wherein the chronograph fulfils the start, stop, zero reset and intermediate time measuring functions, the second operating mode being a mode for adjusting the rest position of the chronograph hand.

A well known problem for this type of watch lies in the fact that the additional hands, which fulfil the chronograph functions, are capable of shifting from the zero position which they should normally indicate when they are in their rest position. This situation generally occurs during manufacturing before the battery is set in place or, subsequently, when the battery has to be replaced or simply removed.

Solutions have been proposed in the prior art to overcome this problem, as in European Patent No. 0 493 613 which discloses an electronic multi-functional watch with an analogue display, having in particular a chronograph function. In a variant, this watch includes three display hands respectively for the hours, minutes and seconds of the current time. The rest position of these hands is adjusted by combined use of a stem-crown having several axial positions and push-buttons. The stem-crown, which includes contacts on its stem, acts as a switch which opens and closes circuits due to the contacts when the crown is pulled out into its different axial positions. In the end axial position, one of the contacts establishes an electric connection between two parts of a circuit used to correct the position of the hands. The watch is then in the hand rest position adjustment mode, and applications of pressure to a first push-button allow the position of a first of these hands to be adjusted, while the position of the two other hands is adjusted using two other push-buttons.

However, this solution has certain drawbacks. In particular, the watch has to be provided with as many push-buttons as there are hands to be adjusted.

Swiss Patent No. 685 467 attempts to overcome these drawbacks by proposing an electronic analogue display multi-functional watch, having in particular a chronograph function, wherein the structure has been simplified to the extreme. The watch disclosed in this document only includes two hands which can act both for indicating the current time and for displaying measured times depending upon the operating mode selected by the user. All the functions or modes of the watch can be accessed by manipulating two control push-buttons, including the hand rest position adjustment function, when the latter are in the display mode corresponding to the chronograph. This structure is advantageous given the reduced number of parts which it requires, however it complicates the use of the watch, insofar as only two buttons provide access to all the functions. Controlling the numerous functions thus gives rise to multiple combinations of short, long or simultaneous applications of pressure on the control buttons. Consequently, unless he has an excellent memory, the user of such a watch has to refer to an instruction manual when he wishes to use a different function to the conventional time setting.

The object of the present invention is thus to provide an electronic chronograph watch with an analogue display, which avoids the aforementioned drawbacks, in particular owing to a simple construction, which is of small thickness and is inexpensive to manufacture, and which also enables the use thereof to be simplified.

The invention thus concerns a watch of the type indicated hereinbefore, characterised in that the two push-buttons are associated with means for accessing the mode for adjusting the rest position of the chronograph hand and for performing said adjustment, and in that said means are activated independently of the position of the stem-crown.

In a particular embodiment, the watch includes at least three chronograph hands capable of displaying measured times on distinct small dials, these chronograph hands preferably being driven by distinct motors.

In a preferred embodiment, means are provided so that a simultaneous application of pressure on both push-buttons causes the watch to pass into the chronograph hand rest position adjustment mode. These means may also be designed such that this passing into adjustment mode is confirmed by a simultaneous rotation of 360 degrees at accelerated speed by the three hands.

These two push-buttons may also be sufficient to perform all the desired operations, by using means such that the function of selecting the chronograph hand whose position has to be adjusted is associated with a first of the buttons, and the function of adjusting the position of the selected chronograph hand by rotation at accelerated speed is associated with the second. The use of such a watch may also be facilitated by making the hand which has just been selected effect a rotation of 360 degrees at accelerated speed. Thus the user selects the chronograph hand whose position he wishes to adjust without any difficulty.

Finally, adjustment of the position of the chronograph hands may be summarized in the steps consisting in:

- exerting pressure simultaneously on the two push-buttons to activate the rest position adjustment mode for said chronograph hands,
- exerting at least one application of pressure on a first push-button to select the chronograph hand to be adjusted,
- exerting discreet applications of pressure or continuous pressure on the second push-button to make the selected hand rotate respectively step by step or at accelerated speed until the desired adjustment is obtained,
- beginning again from the second step to adjust the rest position of the other chronograph hands if necessary,
- waiting a few seconds or pressing both push-buttons simultaneously to deactivate the chronograph hand rest position adjustment mode.

Figure 2:
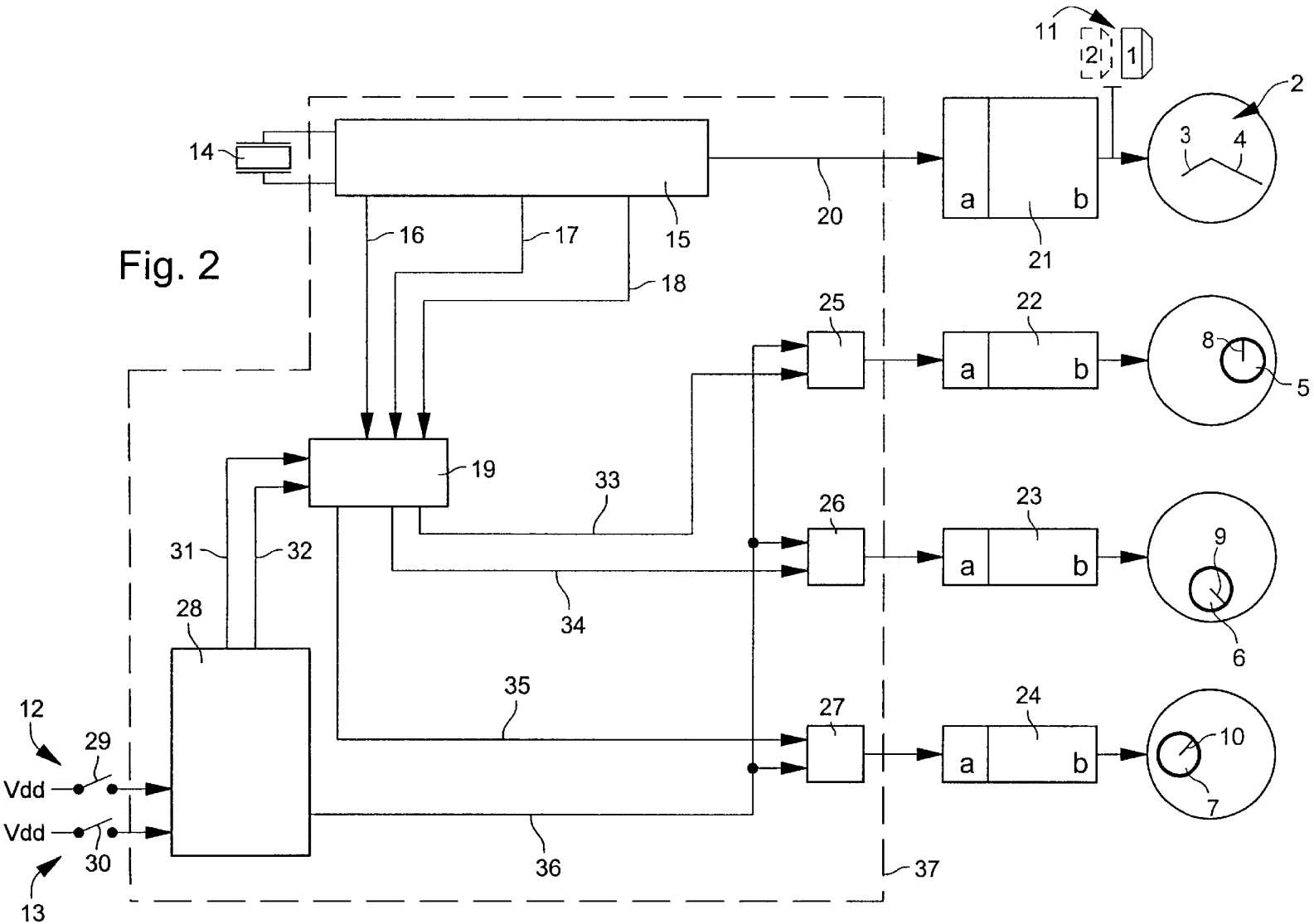
Figures 3, 4:
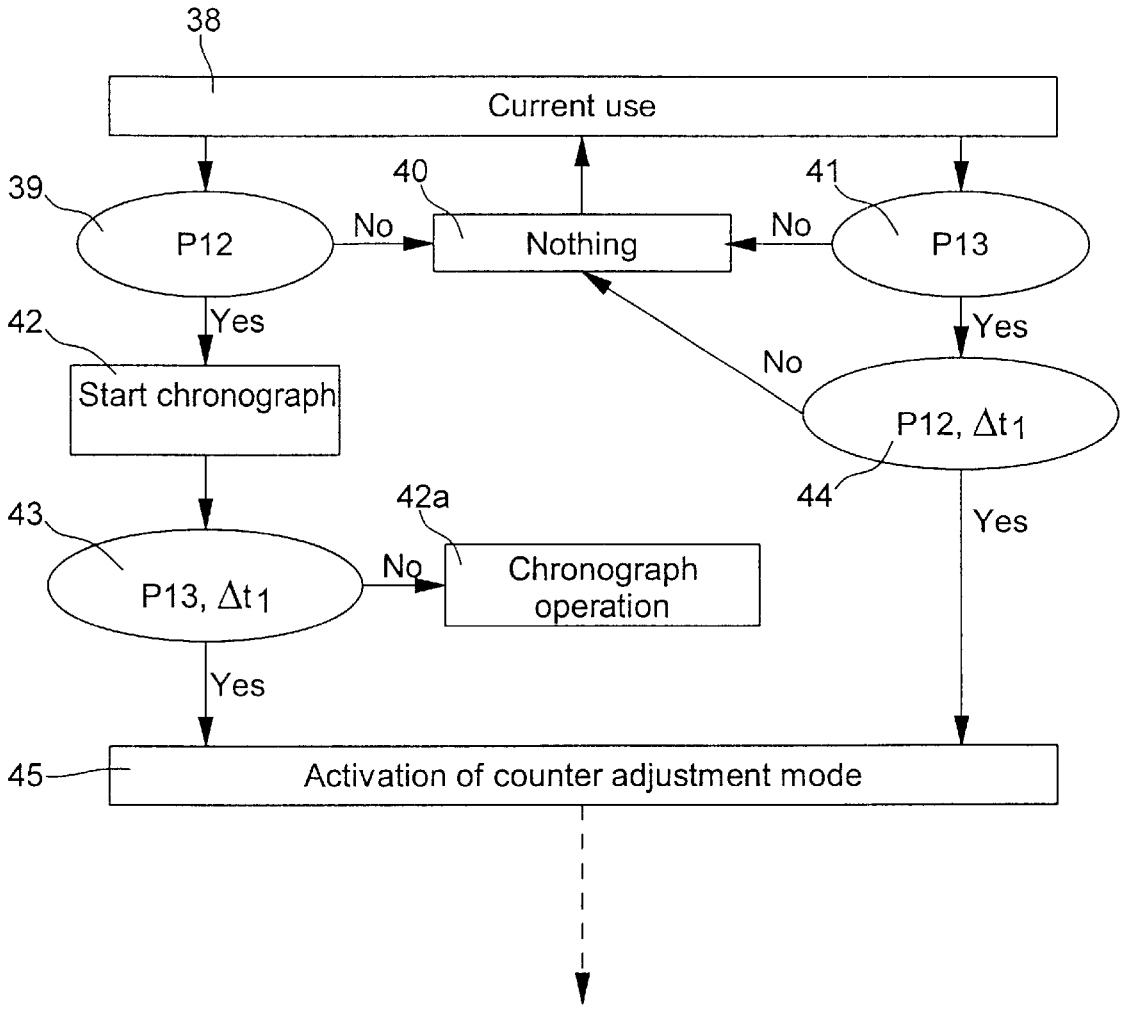
Figure 4:
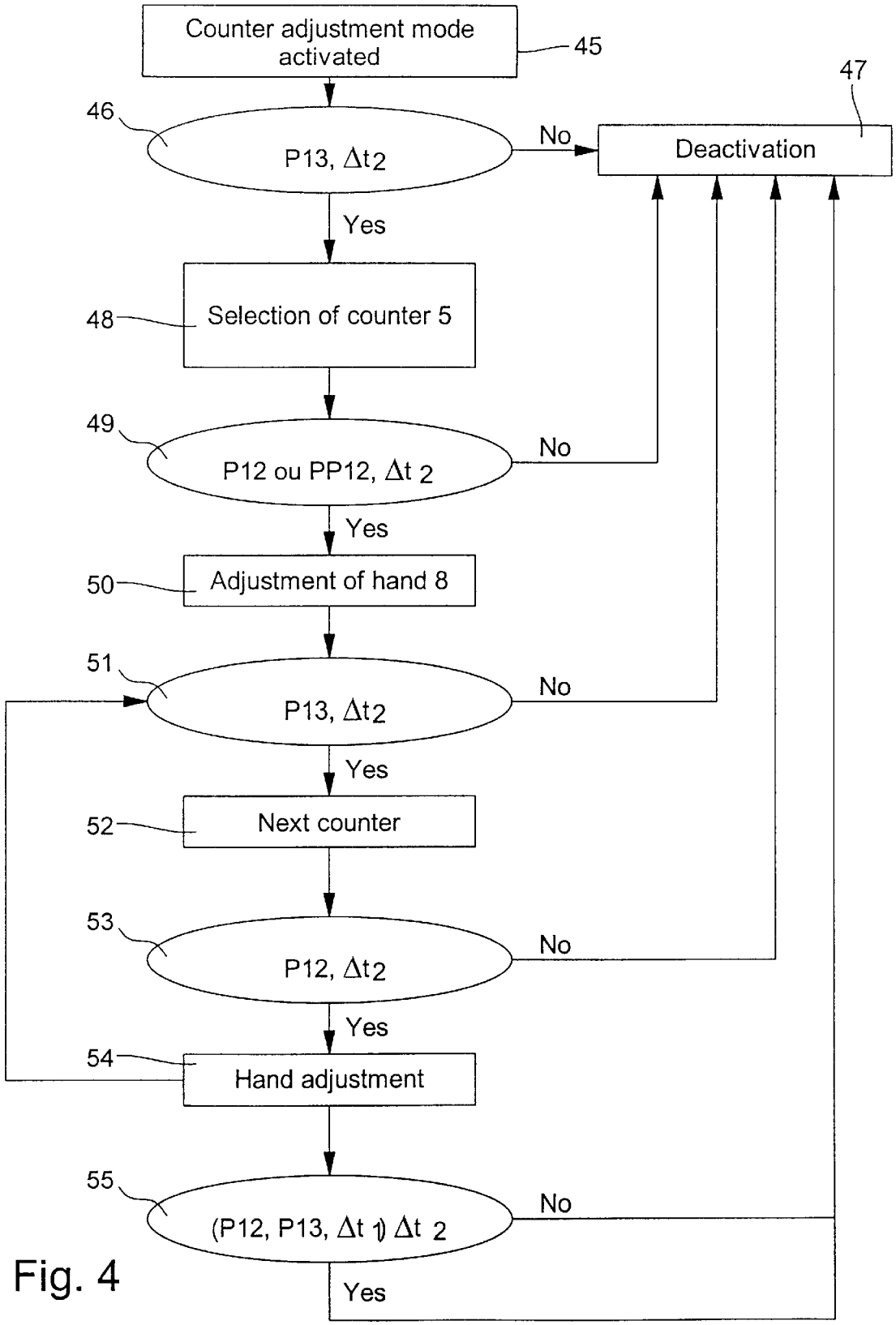

The invention will be better understood with the aid of the following description of an embodiment example made with reference to the annexed drawings, in which:

FIG. 1 is a front view of a preferred embodiment of a wristwatch according to the invention;

FIG. 2 is a simplified diagram of the electric circuit of the watch according to the invention, FIG. 3 is a flow chart showing the steps to be followed to activate the small dial adjustment mode, i.e. adjustment of the rest position of the chronograph hands, in accordance with a preferred embodiment, and FIG. 4 is a flow chart showing the steps to be followed, once the small dial adjustment mode has been activated, to adjust the rest position of the chronograph hands, in accordance with a preferred embodiment of the invention.

Chronograph watch 1, according to a preferred embodiment includes a dial 2 used to indicate the current time via two hands indicating the hours 3 and the minutes 4. This dial 2 further includes three small dials 5, 6 and 7, associated with three small hands 8, 9 and 10 used to indicate measured times. These small dials are located close to the periphery of dial 2, respectively at two o'clock, six o'clock and ten o'clock. They display respectively the tenths of a second measured, the seconds measured, and the minutes measured.

The watch further includes a stem-crown 11 and two push-buttons 12 and 13. In a preferred embodiment, via a well known time setting device using a sliding cannon-pinion, stem-crown 11 enables the position of hands 3 and 4 indicating the current time, to be adjusted or set. The two push-buttons 12 and 13 are of the type described in the European Patent Application filed under No. 00202007. They allow the user of the watch to access all the chronograph functions, via conventional electronic means which are not described, including in particular a microcontroller 37 and controlling three stepping motors each driving one of small hands 8, 9 and 10. In the current operation mode, button 12 fulfils the start, stop and restart functions of the chronograph. Button 13 fulfils the functions of zero resetting the measured time or measuring intermediate times in this mode.

FIG. 2 shows a very simplified diagram of the electric circuit of the chronograph watch which has just been described, this diagram only showing the elements and functions necessary for understanding the invention.

A quartz oscillator vibrating for example at 32768 Hz and whose resonator 14 only is shown in FIG. 2 provides the time base of the watch to a frequency divider 15. The latter generates, on a line 16, clock pulses which are intended to control the electronic functions of the watch. Divider 15 also provides tenths of a second pulses on a line 17 and second pulses on a line 18. These lines are connected to a unit 19 for controlling the timing functions. A line 20 transmits pulses at 0.05 Hertz for example, to a drive unit 21. This drive unit is mechanically coupled to a gear train (not shown) to permanently drive hands 3 and 4 for indicating the current time.

It is to be noted that, in order to illustrate the various roles of the watch hands, on the right of FIG. 2 several replicas of dial 2 are shown with the hand or hands driven by an independent drive unit shown in each of them. The drive units are respectively indicated by the references 21 to 24, each unit including, as is known, a drive circuit indicated by "a" and a stepping motor indicated by "b".

Thus, in addition to drive unit 21 which drives hands 3 and 4 via the gear train, drive unit 22 drives tenths of a second hand 8, drive unit 23 drives seconds hand 9 and drive unit 24 drives minutes hand 10.

Drive units 22 to 24 are associated with respective counters 25 to 27 the states of which reflect, at each instant, the angular positions of the hands to which they correspond. Each counter is set to zero upon initialisation of the associated hand in its rest position and it counts each drive pulse transmitted by timing function control unit 19. Thus, counter 25 can count to ten (tenths of a second), and counters 26 and 27 to sixty.

An input control unit 28 assures the shaping and distribution of the control signals supplied respectively by switches 29 and 30 respectively associated with push-buttons 12 and 13. A command effected by these elements 29 and 30 results, in a known manner, to apply the potential of one of the terminals (here Vdd) of a power source (not shown) such as a battery incorporated in watch 1, to control unit 28.

As a function of actions on push-buttons 12 and 13, input control unit 28 elaborates a start/stop timing control signal or a change of operating mode signal on a line 31, and a zero reset signal on a line 32, lines 31 and 32 being connected to timing function control unit 19.

The latter generates respectively on lines 33 to 35 control pulses intended for counters 25 to 27. The latter can also be positioned directly by input control unit 28 via a control line 36.

All the functions fulfilled by the watch which has just been described will preferably be performed by a microcontroller which those skilled in the art will know how to programme accordingly with the aid of the description which has just been made and that which follows regarding the operation of the watch. This microcontroller is globally designated by the reference 37 in FIG. 2.

During operation in current time mode, the watch causes hands 3 and 4 to rotate via drive unit 21 controlled by the pulses at 0.05 Hertz transiting on line 20.

When the watch is set to the timing function via an application of pressure on push-button 12, timing control unit 19 applies the appropriate control signals to lines 34 and 35 so that via respectively counters 26 and 27 and drive units 23 and 24, hands 9 and 10 display respectively the timed seconds and minutes.

During this time, an internal counter of timing function control unit 19 which is not shown receives tenth of a second pulses but does not send them immediately to counter 25. Drive unit 22 thus remains inactive and hand 8 stationary.

Another application of pressure on push-button 12 stops the timing. Hands 9 and 10 stop, while drive unit 22 is activated by timing function control unit 19, via the internal counter and counter 25, so that hand 8 advances to the angular position corresponding to the number of tenths of a second counted at the moment timing stopped.

When push-button 13 is activated for the zero resetting, hands 8 to 10 are returned to their rest position.

A simultaneous application of pressure to push-buttons 12 and 13 activates the mode for adjusting the small dials of the chronograph, i.e. the mode for adjusting the rest position of hands 8, 9 and 10.

In a preferred embodiment, the chronograph dial adjustment mode can only be activated when the chronograph is stopped and in the rest position, counters 25 to 27 being at zero. Passage into this mode is confirmed by the generation of control pulses by input control unit 28, intended for counters 25 to 27, via line 31 and timing function control unit 19. These control pulses will activate the drive units 22 to 24, causing simultaneous rotation through 360 degrees respectively of hands 8 to 10, at accelerated speed. Buttons 12 and 13 then fulfil new functions. Indeed, a first application of pressure on button 13 enables hand 8 to be selected, which is confirmed by the generation of control signals by input control unit 28 causing, via line 31 and timing function control unit 19, drive unit 22 to be activated and said hand to rotate through one complete revolution at accelerated speed. Each subsequent application of pressure on button 13 has the effect of selecting the next hand, activating the corresponding drive unit via input control unit 28, line 31 and timing function control unit 19, at the same time deactivating the drive motor corresponding to the previously selected hand. The pulses thereby generated cause the newly selected hand to rotate through one complete revolution at accelerated speed. The function of button 12 is to control the motor driving the selected hand. Indeed, each application of pressure on button 12 causes a pulse to be generated by input control unit 28, sent to the counter corresponding to the selected hand via control line 36 thus causing the corresponding drive unit to operate. Preferably, in a known manner, each short application of pressure on button 12 causes the corresponding hand to rotate through one step, while a long application of pressure causes a train of pulses to be generated and thus the hand to rotate at accelerated speed. When the watch is in small dial adjustment mode, another simultaneous application of pressure on buttons 12 and 13 deactivates this mode and counters 25 to 27, thus causing the watch to pass into current operating mode preferably with a simultaneous rotation through 360 degrees by hands 8 to 10, at accelerated speed.

Thus, the method for adjusting the rest position of hands 8, 9 and 10 relies exclusively on the functions of push-buttons 12 and 13 as described hereinbefore. Consequently, such a structure enables any electric contacts cooperating with stem-crown 11 to be omitted. This provides both a saving in space in the watch case, thus representing a significant advantage for the manufacture of watches of reduced size, and saving with respect to the number of parts used, which represents a significant advantage for the manufacture of watches produced in large numbers.

The standard development of a sequence for adjusting the rest positions of these hands is schematised by the flow charts of FIGS. 3 and 4, in which the following notations are used:

- P12 means that the user is exerting a short application of pressure on button 12;
- P13 means that the user is exerting a short application of pressure on button 13;
- PP12 means that the user is exerting a long application of pressure on button 12;
- $\Delta t_1$ represents a time interval of the order of a tenth of a second; and
- $\Delta t_2$ represents a time interval of the order of several seconds.

The watch is first of all in current operating mode 38, i.e. it indicates simply the current time by means of hands 3, 4 and dial 2. Further, chronograph hands 8 to 10 are immobile, in their rest position. Let us assume that at least one of these hands 8 to 10 has a rest position which is not located at the zero position of the corresponding small dial, so that an adjustment of its rest position is necessary. This may occur, as was seen previously, when the battery is set in place during manufacturing or when it is subsequently replaced. This is why it is useful to provide means so that the user can make this adjustment himself, and especially so that it is not necessary to dismantle the watch. It will thus be understood that this system, which is practical for any type of electronic chronograph watch with additional dials, is all the more so for watches which cannot be dismantled once their construction is complete. It can be seen in FIG. 3 at 39, 40 and 41, that if the user does not press any of the buttons, the watch naturally remains in the current operating mode.

If the user applies a pressure on button 12, which is shown at 42, the chronograph is started and two options then arise. At reference 43, if he does not press button 13 in a time interval $\Delta t_1$, preferably of the order of a tenth of a second, this interval being determined during manufacturing and possibly being able to be modified subsequently by a repairer, the chronograph continues to run, which is represented by reference 42*a*. In this case, the two push-buttons 12 and 13 fulfil the conventional functions, which are not shown, namely, another application of pressure on button 12 stops the chronograph and the measured time is displayed, while an application of pressure on button 13 displays an intermediate time measured. Thus, the chronograph continues to run until button 12 is pressed again. Once the chronograph has stopped, an application of pressure on button 13 has the effect of returning the three hands 8, 9 and 10 to their rest position at accelerated speed, which returns the watch to its current operating mode 38. If, after the first application of pressure on button 12, the user presses button 13 within time interval $\Delta t_1$, at 43, the mode 45 for adjusting small dials is activated, which is confirmed by a rapid rotation through 360 degrees of the three hands 8, 9 and 10. In this case and in accordance with a preferred embodiment, the chronograph is reinitialised before activation of the adjustment mode.

If the user begins by pressing on button 13, which is shown at 41, adjustment mode 45 is activated provided that he presses button 12 within time interval $\Delta t_1$, which is shown at 44, otherwise nothing happens, 40, and the watch remains in its current operating mode 38.

The flow chart of FIG. 4 describes in detail the sequence of manipulations to be performed in order to adjust the rest position of hands 8, 9 and 10, in accordance with a preferred embodiment of the invention. The first step 45 of FIG. 4 thus corresponds to the last step of FIG. 3. It may be noted that prolonged inactivity of the user during a period of time greater than $\Delta t_2$, i.e. approximately 5 seconds in this embodiment, causes the small dial adjustment mode to be spontaneously deactivated and the watch to return to its current operating mode. It should also be noted that this deactivation may occur at any step of the adjustment sequence, and is indicated to the user by a rapid rotation through a complete revolution of hands 8, 9 and 10.

Once the small dial adjustment mode has been activated, the user has to press button 13 within time interval $\Delta t_2$, which is shown at 46, in order to select small dial 5 and hand 8, at 48, which is confirmed by the rapid rotation through a complete revolution of said hand. The latter can then be adjusted, by manipulating button 12, which is schematised at 49 and 50. In this mode, hand 8 is controlled by button 12, via a motor, so that a short application of pressure causes hand 8 to rotate through one unit of small dial 5, while a long application of pressure causes the hand to rotate continuously at accelerated speed. Once hand 8 has been adjusted, one is at 51, where the user can either press on button 13 before the expiry of time $\Delta t_2$, to select another hand, or wait for the adjustment mode to be spontaneously deactivated if there are no further adjustments to be made. Each new application of pressure on button 13 causes one to pass to the next small dial in the clockwise direction. The small dial selected is indicated each time by the rapid rotation through a complete revolution of the corresponding hand, this being schematised in the flow chart by references 51 to 54. When the rest position has been adjusted for each hand one is at 55, and the user can either wait for time $\Delta t_2$, or press buttons 12 and 13 within a time interval less than $\Delta t_1$ to deactivate the mode for adjusting the small hands at 47, and return to current operating mode 38.

Of course, the preceding description corresponds to a preferred embodiment of the invention and cannot in any way be considered as limiting its scope. Indeed different programming sequences may easily be imagined for the microcontroller, so that the method for adjusting the rest position of the additional hands may be different. One could also provide a different number of small dials for the chronograph, a display of the day of the date which might be adjusted with the stem-crown, in a conventional manner.

What is claimed is:

1. An analogue electronic chronograph watch including at least a first motor driving hands for displaying the current time, at least a second motor driving at least a chronograph hand, a stem-crown for adjusting the current time and two push-buttons for controlling the chronograph functions, the watch comprising two operating modes for the chronograph, the first of these modes being a current operating mode in which the chronograph fulfils at least start, stop and zero reset functions, the second operating mode being a mode for adjusting the rest position of the chronograph hand, wherein the two push-buttons are associated with means for accessing the rest position adjustment mode of the chronograph hand and performing said adjustment and, in that said means are activated independently of the position of the stem-crown.

2. An analogue electronic chronograph watch according to claim 1, wherein it includes at least three chronograph hands capable of displaying the measured times on distinct small dials.

3. An analogue electronic chronograph watch according to claim 2, wherein each of said three hands is driven by its own motor.

4. An analogue electronic chronograph watch according to claim 1, wherein said means are also designed so that a simultaneous application of pressure on the two push-buttons causes the watch to pass into the rest position adjustment mode for said chronograph hand.

5. An analogue electronic chronograph watch according to claim 2, wherein said means are also designed so that a simultaneous application of pressure on the two push-buttons causes the watch to pass into the rest position adjustment mode for said chronograph hand.

6. An analogue electronic chronograph watch according to claim 3, wherein said means are also designed so that a simultaneous application of pressure on the two push-buttons causes the watch to pass into the rest position adjustment mode for said chronograph hand.

7. An analogue electronic chronograph watch according to claim 6, wherein said means are also designed to cause said chronograph hands to rotate through 360 degrees at accelerated speed when said rest position adjustment mode is selected.

8. An analogue electronic chronograph watch according to claim 2, wherein the means are also designed, when it is in the rest position adjustment mode for said hands, so that the choice of hand to be adjusted is associated with a first of said push-buttons, and that the function of adjusting the rest position of said selected hand is associated with the other push-button.

9. An analogue electronic chronograph watch according to claim 7, wherein said means are also designed, when it is in the rest position adjustment mode for said hands, so that the choice of hand to be adjusted is associated with a first of said push-buttons, so that the function of adjusting the rest position of said selected hand is associated with the other push-button and so that said selected hand rotates through 360 degrees at accelerated speed in response to activation of said first push-button.

10. A method for adjusting the rest position of the chronograph hands of an analogue electronic chronograph watch including hands for displaying the time, at least two chronograph hands, a stem-crown, for adjusting the hour and minute and two push-buttons for controlling the chronograph functions, the watch including two operating modes for the chronograph, the first of these modes being the current operating mode in which the chronograph fulfils the start, stop, zero reset and intermediate time measurement functions, the second operating mode being a mode for adjusting the rest position of the chronograph hands, the method including the steps of exerting pressure simultaneously on said two push-buttons to activate the rest position adjustment mode for said chronograph hands, exerting at least one application of pressure on a first push-button to select the chronograph hand whose rest position has to be adjusted, exerting respectively discreet applications of pressure or continuous pressure on the other push-button to make the selected hand rotate respectively step by step or at accelerated speed until the desired adjustment is obtained, beginning again from the second step to adjust the rest position of said other chronograph hands if necessary, waiting a few seconds or pressing both push-buttons simultaneously to deactivate the chronograph hand rest position adjustment mode.

11. A method for adjusting the rest position of chronograph hands according to claim 10, wherein when the rest position adjustment mode for the chronograph hands is activated, said hands effect a rotation of 360 degrees at accelerated speed to confirm the change of mode.

12. A method for adjusting the rest position of chronograph hands according to claim 10, wherein in the rest position adjustment mode for the chronograph hands each application of pressure on said first push-button allowing one of said hands to be selected, is confirmed by a rotation of 360 degrees at accelerated speed by the hand selected.

13. A method for adjusting the rest position of chronograph hands according to claim 11, wherein in the rest position adjustment mode for the chronograph hands each application of pressure on said first push-button allowing one of said hands to be selected, is confirmed by a rotation of 360 degrees at accelerated speed by the hand selected.

14. A method for adjusting the rest position of chronograph hands according to claim 13, wherein the change out of the rest position adjustment mode for the chronograph hands is confirmed by a rotation of 360 degrees at accelerated speed by said hands.

* * * * *